US009476377B2

(12) United States Patent
Benson

(10) Patent No.: US 9,476,377 B2
(45) Date of Patent: Oct. 25, 2016

(54) SYSTEM, METHOD, AND APPARATUS FOR FUEL INJECTION CONTROL

(71) Applicant: Cummins Inc., Columbus, IN (US)

(72) Inventor: Donald J. Benson, Columbus, IN (US)

(73) Assignee: Cummins Inc., Columbus, IN (US)

( * ) Notice: Subject to any disclaimer, the term of this patent is extended or adjusted under 35 U.S.C. 154(b) by 276 days.

(21) Appl. No.: 14/223,733

(22) Filed: Mar. 24, 2014

(65) Prior Publication Data

US 2014/0283792 A1 Sep. 25, 2014

Related U.S. Application Data

(60) Provisional application No. 61/804,482, filed on Mar. 22, 2013.

(51) Int. Cl.

| | |
|---|---|
| ***F02D 41/24*** | (2006.01) |
| ***F02D 41/38*** | (2006.01) |
| *F02D 41/20* | (2006.01) |
| *F02D 41/22* | (2006.01) |

(52) U.S. Cl.

CPC ..... *F02D 41/2467* (2013.01); *F02D 41/3809* (2013.01); *F02D 41/221* (2013.01); *F02D 2041/2055* (2013.01); *F02D 2041/224* (2013.01); *F02D 2200/0602* (2013.01); *F02D 2200/0606* (2013.01); *F02D 2200/0616* (2013.01); *F02D 2200/101* (2013.01)

(58) Field of Classification Search

CPC ..... F02D 2041/2055; F02D 41/2467; F02D 41/3818; F02D 41/3827; F02D 2200/0614; F02D 2200/0616; F02D 2200/0618

See application file for complete search history.

(56) References Cited

U.S. PATENT DOCUMENTS

| | | | | |
|---|---|---|---|---|
| 6,557,530 | B1 | 5/2003 | Benson et al. | |
| 7,769,530 | B2 | 8/2010 | Hehle et al. | |
| 7,891,339 | B2 | 2/2011 | Takahashi et al. | |
| 2009/0182487 | A1* | 7/2009 | Halleberg | F02D 41/1497 701/106 |
| 2009/0299608 | A1* | 12/2009 | Loeffler | F02D 35/023 701/104 |
| 2010/0263632 | A1 | 10/2010 | Miyake et al. | |
| 2011/0100333 | A1 | 5/2011 | Toyohara et al. | |
| 2012/0166067 | A1* | 6/2012 | Parrish | F02D 41/40 701/104 |
| 2013/0103287 | A1* | 4/2013 | Li | F02D 41/401 701/105 |
| 2013/0197781 | A1* | 8/2013 | Shin | F02D 41/2438 701/103 |
| 2013/0327297 | A1* | 12/2013 | Sgatti | F02D 41/2467 123/456 |
| 2014/0100761 | A1* | 4/2014 | Empacher | F02D 41/2467 701/104 |
| 2014/0102186 | A1* | 4/2014 | Leblon | F02D 35/023 73/114.48 |
| 2014/0216409 | A1* | 8/2014 | Katsura | F02D 41/3809 123/456 |
| 2014/0224218 | A1* | 8/2014 | Carey | F02D 41/2441 123/447 |
| 2015/0053179 | A1* | 2/2015 | Baqasse | F02D 41/2467 123/435 |

* cited by examiner

*Primary Examiner* — Erick Solis
(74) *Attorney, Agent, or Firm* — Taft Stettinius & Hollister LLP

(57) ABSTRACT

A method includes determining a stored injection relationship that includes a number of fuel performance parameters. In one form the fuel performance parameters are related to a particular shape, and may be related to a particular operating condition. The method includes determining a fuel performance outcome during a fuel injection event, and updating the stored injection relationship in response to the fuel performance outcome. The fuel performance outcome can be an injected fuel quantity.

22 Claims, 12 Drawing Sheets

204– original curve
304 – adjusted curve
306– start delay
308– end delay
310– peak rate
312– opening time to peak
314– closing time to peak
116– injection command
318 - injection duration

400

416- injection command
402-nominal curve (initial)
404-adjusted curve (after performance change)
406-nominal injection delay (initial)
408- adjusted injection delay (after performance change)

500

502 – adjusted curve
204 – initial curve

SYSTEM, METHOD, AND APPARATUS FOR FUEL INJECTION CONTROL

CROSS-REFERENCE TO RELATED APPLICATION

The present application claims the benefit of the filing date of U.S. Provisional Patent Application No. 61/804,482 filed on Mar. 22, 2013, which is incorporated herein by reference in its entirety.

BACKGROUND

The technical field generally relates to high pressure fuel injectors. High pressure fuel injectors exhibit delay periods after the command of opening and closing of the injector, and additionally can experience variations in the injector response during fuel injection. These variations affect the actual amount of fuel injected versus the commanded amount of fuel, and can additionally affect the emissions performance and torque generation of the engine that utilizes the fuel injector. Direct feedback measurement of the injector opening and closing events and of the fuel injection characteristics is difficult to obtain with commercially reasonable hardware on a production engine. Therefore, further technological developments are desirable in this area.

SUMMARY

One embodiment is a unique method for diagnosing and adjusting control of a fuel injector. Other embodiments include unique methods, systems, and apparatus to tune and control a fuel injector. This summary is provided to introduce a selection of concepts that are further described below in the illustrative embodiments. This summary is not intended to identify key or essential features of the claimed subject matter, nor is it intended to be used as an aid in limiting the scope of the claimed subject matter. Further embodiments, forms, objects, features, advantages, aspects, and benefits shall become apparent from the following description and drawings.

DESCRIPTION OF ILLUSTRATIVE EMBODIMENTS

Figure 1:
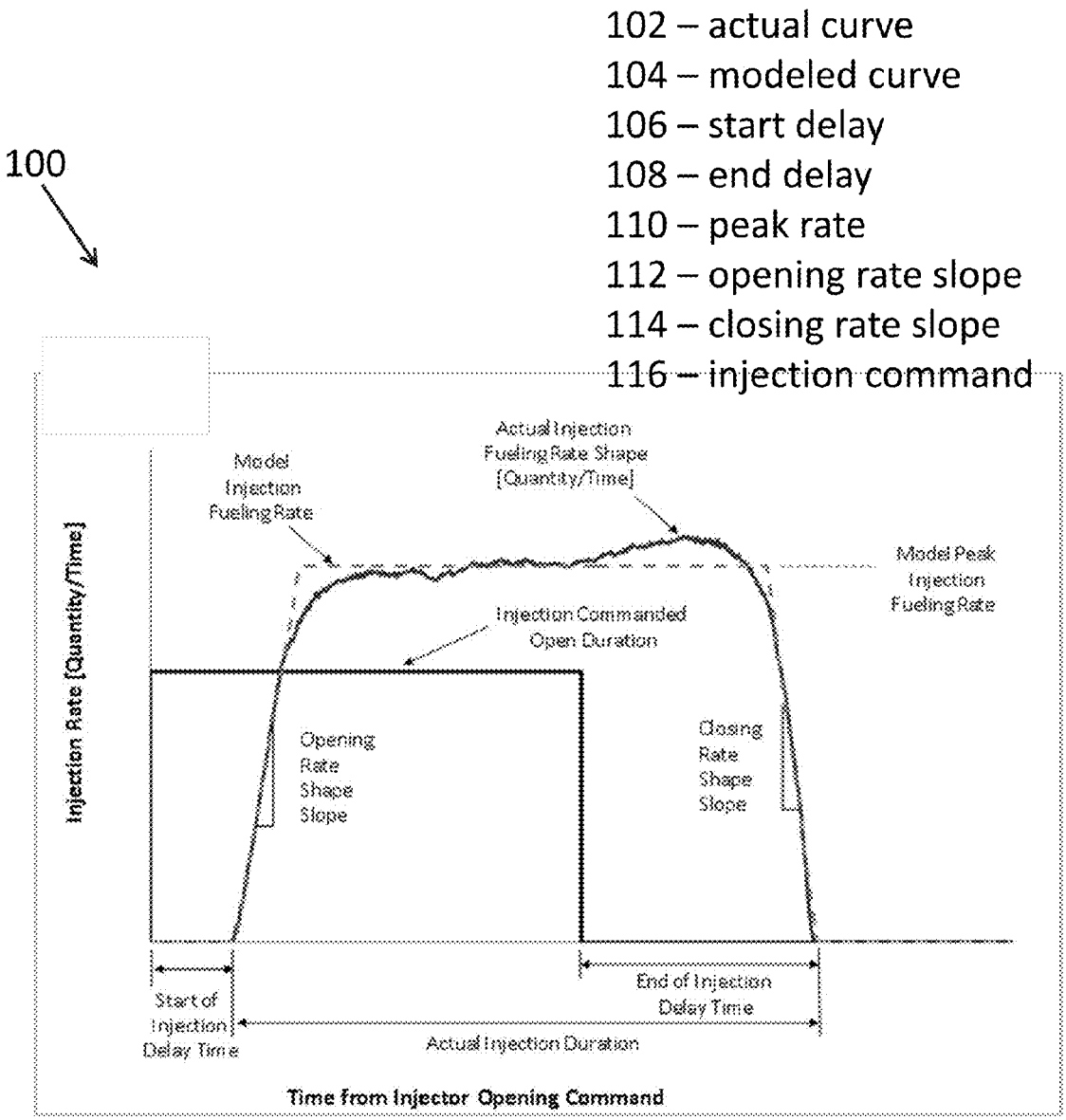
FIG. 1 is a schematic diagram of a fuel injection relationship.

For the purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated embodiments, and any further applications of the principles of the invention as illustrated therein as would normally occur to one skilled in the art to which the invention relates are contemplated herein.

An example system includes an internal combustion engine having a common rail fuel system and at least one common rail fuel injector. Example systems may include any number of common rail fuel injectors, and may include multiple banks of fuel injectors. The system includes a means for modeling the fuel injector fuel quantity delivered as a function of a fueling command value. A non-limiting example means for modeling the fuel injector fuel quantity delivered as a function of a fueling command value is described following. Any means for modeling the fuel injector fuel quantity delivered as a function of a fueling command value otherwise described herein is also contemplated herein.

As will be appreciated by the description that follows, the techniques described herein that relate fuel injection parameters, such as relating estimated injected fuel quantity to a rate shape characteristic parameter associated with a rate shape model, can be implemented in a controller that includes one or more modules. In one form the controller is an engine controller such as a diesel engine controller. The module can be comprised of digital circuitry, analog circuitry, or a hybrid combination of both of these types. Also, the module can be programmable, an integrated state machine, or a hybrid combination thereof. The module can include one or more Arithmetic Logic Units (ALUs), Central Processing Units (CPUs), memories, limiters, conditioners, filters, format converters, or the like which are not shown to preserve clarity. In one form, the module is of a programmable variety that executes algorithms and processes data in accordance with operating logic that is defined by programming instructions (such as software or firmware). Alternatively or additionally, operating logic for the module can be at least partially defined by hardwired logic or other hardware. It should be appreciated that module can be exclusively dedicated to estimating a fuel quantity and relating that fuel quantity to one or more parameters associated with the definition of a rate shape.

Referencing FIG. 1, illustrative data 100 depicts an illustrative "actual" injection fueling rate shape 102 with a modeled injection rate shape 104. The actual injection fueling rate shape 102 is a representative example of what an actual injection rate shape might look like, and does not represent an actual fueling rate shape for any specific system. It can be seen that, for the actual injection fueling rate shape 102, a trapezoidal injection rate shape can be utilized to closely approximate the injected fuel, especially where the area under the curves must be matched (representing the total fuel injected) rather than the instantaneous injected fueling amounts. The curves 102, 104 are responses of the injector to an injection command 116, which demonstrates a command to open the injector at time zero, and a command to close the injector at a later time where the command value returns to zero.

Both the trapezoidal model curve 104 and the actual curve 102 exhibit a start delay time 106 before the injector is open and fuel injection begins, and an end delay time 108 which occurs at some period of time after the injection command returns to zero (or OFF). The start delay time 106 and end delay time 108 are normal responses of a properly functioning injector, and are predictable and can be indicative of injector health.

Both the trapezoidal model curve 104 and the actual curve 102 exhibit an opening rate shape slope 112 and a closing rate shape slope 114, which are linear in the real system through a large fraction of the opening and closing events. The trapezoidal model curve 104 includes a peak injection rate 110 portion. While the actual curve 102 exhibits some rate increase throughout the injection event until some time period after the injection command 116 returns to zero, a single peak injection rate 110 can nevertheless provide an injection rate shape that closely estimates the amount of fuel injected throughout the fueling event. In certain embodiments, a quadrilateral or other shape may be used for the approximation, allowing for a slope or other function during the peak injection period after the injection rate rise and before the injection rate fall.

The values of delay times 106, 108, peak rates 110, and rise and fall slopes 112, 114 are dependent upon the system operating conditions. For example, a given set of values may be dependent upon the fuel rail pressure of the system. In certain additional or alternative embodiments, the on-time of the injection command, the temperature of the fuel, the engine speed of the engine having the fuel system, the discharge pressure of the injector, and/or any other parameter affecting the fuel injection amount may be utilized as system operating conditions. Accordingly, multiple values for each modeling parameter (delay times 106, 108, peak rates 110, rise and fall slopes 112, 114) may be stored corresponding to various operating conditions, and/or values for the modeling parameters stored as functions of the operating conditions may be stored.

Figure 2:
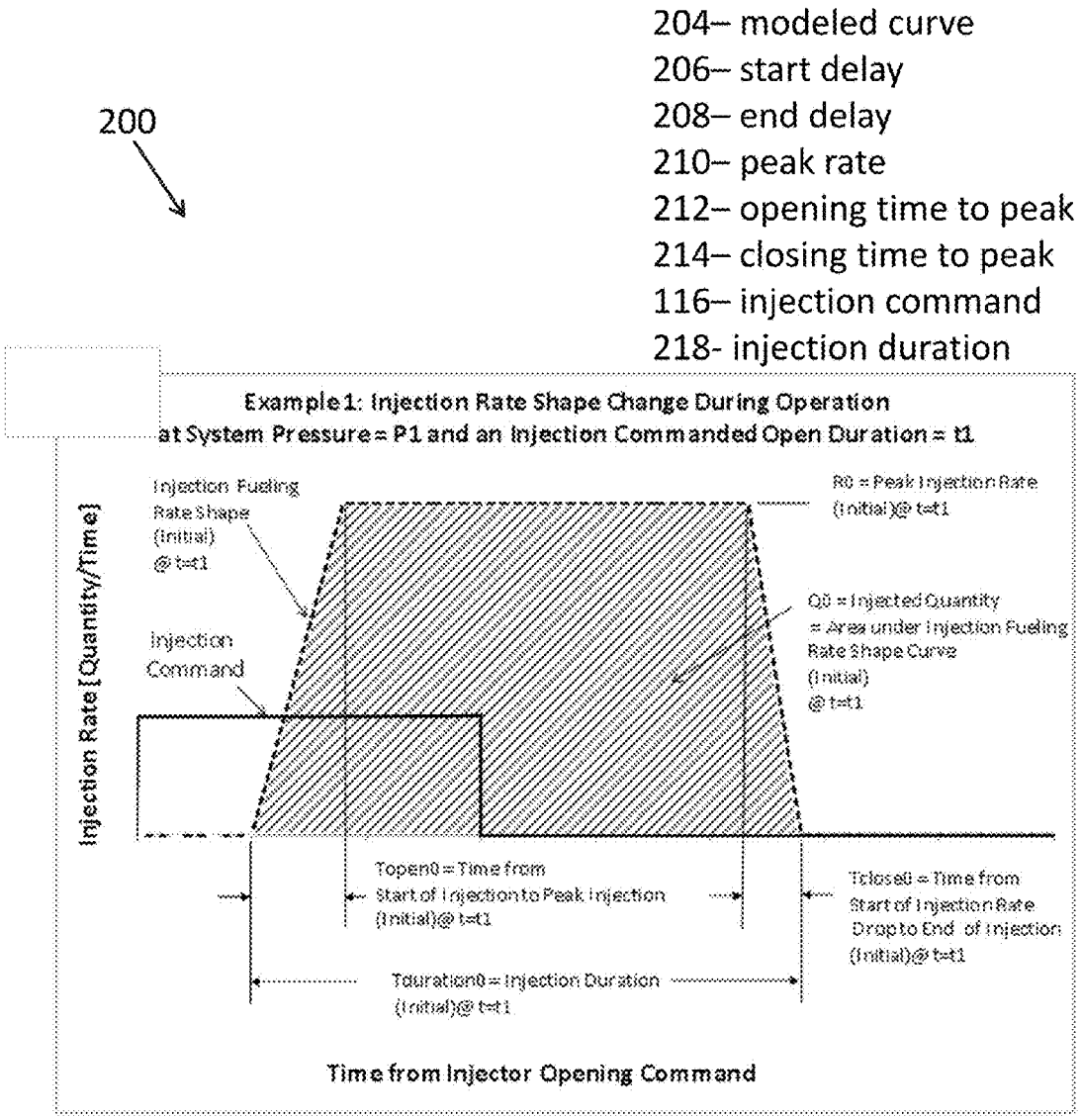
FIG. 2 is a schematic diagram of another embodiment of a fuel injection relationship.

Referencing FIG. 2, an initial condition for operating pressure P1 and commanded injection time T1 is depicted. The data 200 for FIG. 2 may be determined from initial calibration data, data entered at a time of manufacture, and/or data taken during a previous operation of the system and stored as a contemporary characterization of the injector at the time the data is taken. The data 200 includes a modeled curve 204 for the fueling amount, a start delay 206 and an end delay 208, along with a peak rate 210 for the fueling. The data 200 in the example stores an opening time to peak 212, and a closing time from peak 214, contrasted with but equivalent to the slopes 112, 114 stored in the data from FIG. 1. Slopes, rise-times and fall-times, or any equivalent data structures may be utilized to characterize the rising and falling injection rate descriptions. The data 200 also includes a total injection duration 218, which may alternatively or equivalently be stored as a time at peak fueling or some other time from which the total fueling amount can be determined. The area under the modeled curve 204 is the total fueling amount for the injection event depicted in the data 200.

Figure 3:
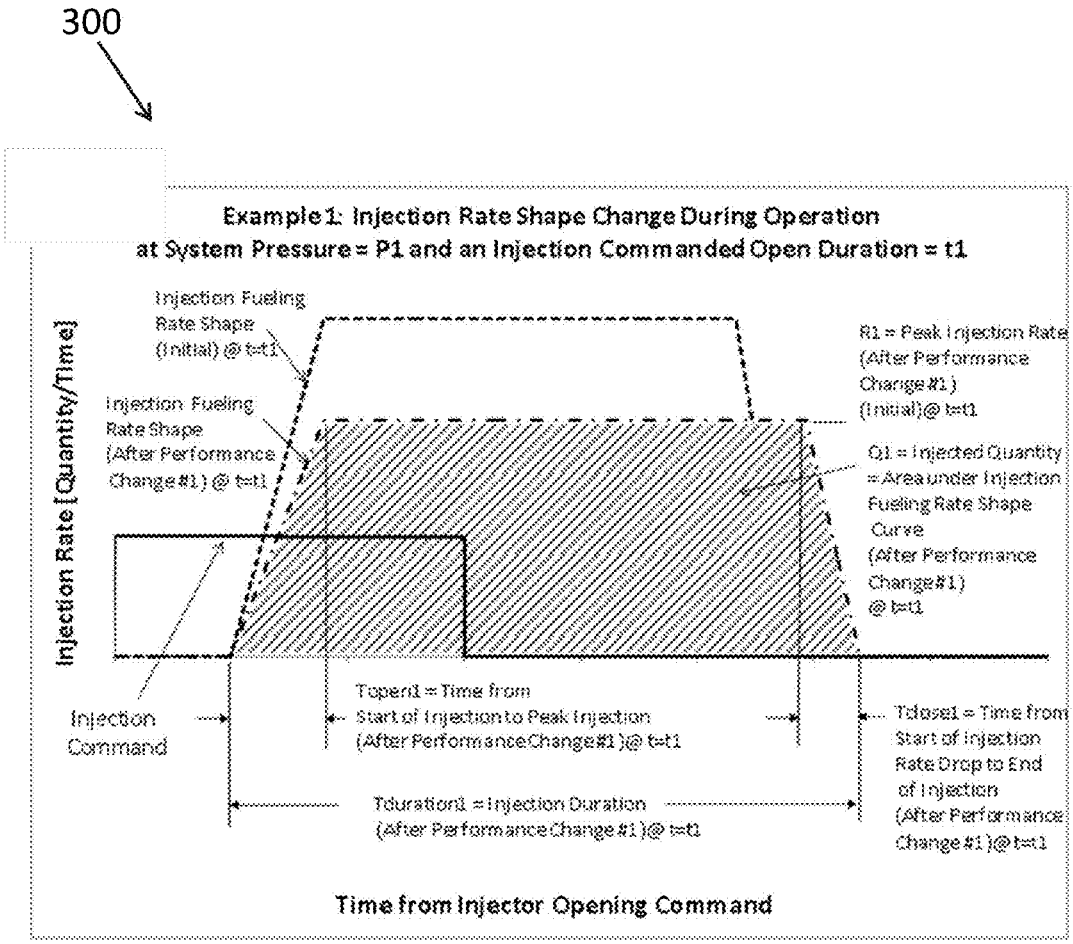
FIG. 3 is a schematic diagram of a fuel injection relationship and an adjusted fuel injection relationship.

Referencing FIG. 3, an adjusted condition for the operating pressure P1 and the commanded injection time T1 is depicted. The adjusted curve 304 is determined by utilizing a fuel amount virtual sensor in real time, and determining the adjusted start delay 306, adjusted peak rate 310, and adjusted end delay 308. The area under the adjusted curve 304 is utilized to determine the fuel amount injected during the fueling event at P1, T1. Additionally or alternatively, the adjusted curve 304 may be utilized to diagnose the injector, for example when any one or more of the adjusted start delay 306, adjusted end delay 308, and/or adjusted peak rate 310 are greater than a predetermined amount different than a nominal value. Additionally or alternatively, the adjusted curve 304 may be utilized to adjust offset data, for example where an adjusted curve 304 is determined for a first pressure P1 and a second pressure P3, the data for a third pressure P2 falling between P1 and P3 may be adjusted similarly to the adjusted data for the pressures P1 and P3. For all operating conditions there can be a direct correlation between the adjusted curve parameters at that condition and the injected fueling quantity. The integrated area under the curve equals the injected fueling quantity at each operating condition. By utilizing relationships between parameters in a control structure, all rate shape defining parameters such as start delay, end delay, peak rate, and slopes can be estimated at all operating conditions including those for which no direct fueling measurement was taken. Any fuel amount virtual sensor in real time, or any fuel amount sensor, may be utilized. A non-limiting example of an injected fuel quantity estimator is described in U.S. Pat. No. 6,557,530 entitled "Fuel control system including adaptive injected fuel quantity estimation," which is incorporated herein by reference in the entirety for all purposes. Any other injected fuel quantity estimator may be utilized herein to determine adjusted data such as that depicted in FIG. 3.

Figure 4:
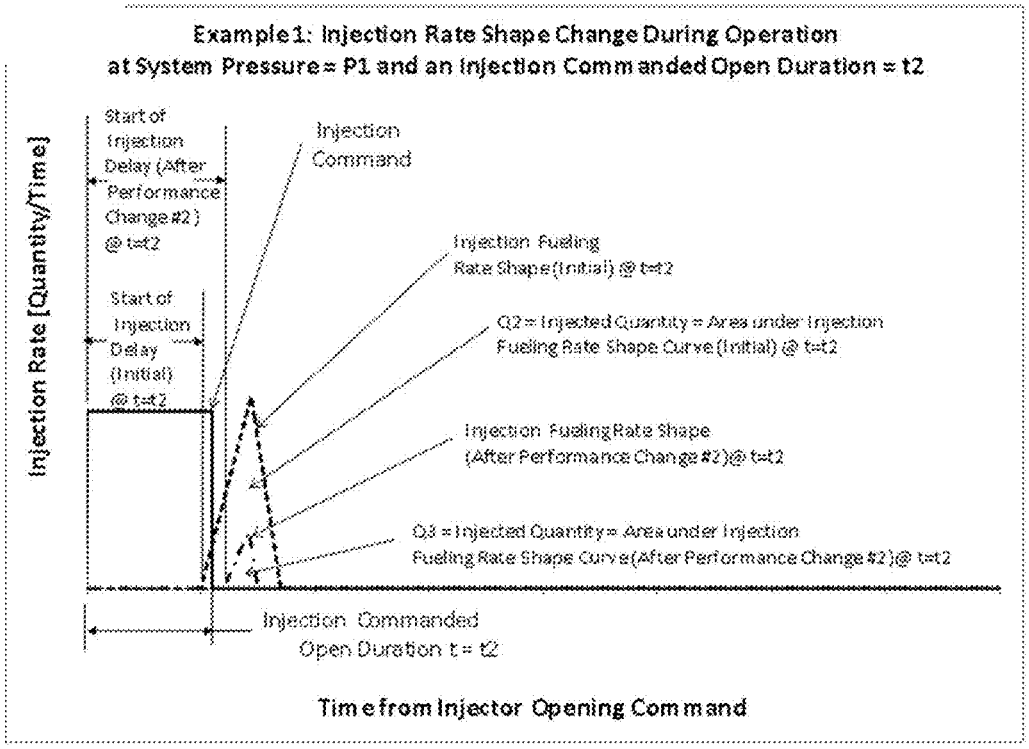
FIG. 4 is a schematic diagram of another embodiment of a fuel injection relationship and an adjusted fuel injection relationship.

Referencing FIG. 4, example data 400 is depicted for a fuel injection event having a pressure P1 and an injection command time 416 of T2. The pressure is indicated at P1 to illustrate that the data 400 may share an operating condition (fuel pressure in the present instance) with the data 200 depicted in FIG. 2 but have a different final form due to the difference in operating condition T2. The nominal curve 402 and adjusted curve 404 are depicted together on FIG. 4. Due to the short injection command time 416, the injection is modeled as a triangle injection rate shape in FIG. 4. The actual injection delay 408 is longer than the nominal injection delay 406, and accordingly the amount of fuel injected (area under adjusted curve 404) is much smaller than the expected fuel amount of fuel injected (area under nominal curve 402). If the fueling controls are not aware of and compensate for the actual injection delay 408, the injector performance may affect the performance or emissions outcome of the system in a situation as depicted in FIG. 4 (e.g. pilot or post injection events of short duration may fail to serve the intended purpose). A torque based check of the fuel injection in a situation such as that depicted in FIG. 4 is unlikely to have the required resolution and precision to diagnose or compensate for the injector change from nominal such as that depicted in FIG. 4.

Figure 5:
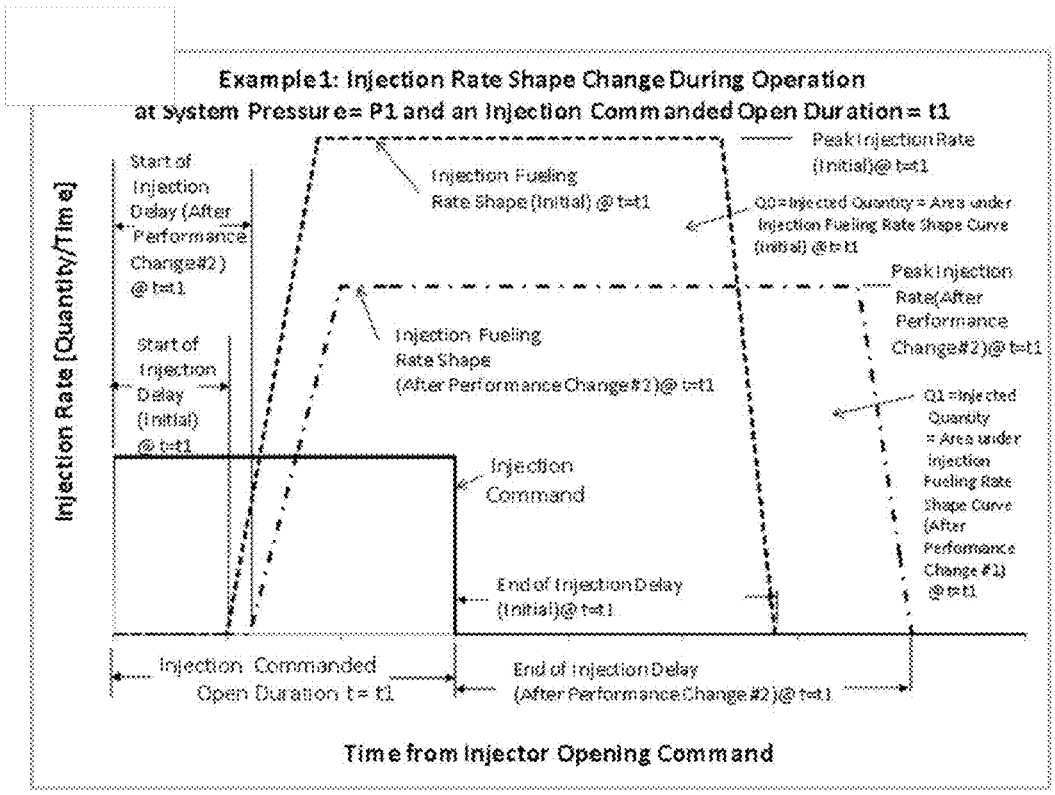
FIG. 5 is a schematic diagram of another embodiment of a fuel injection relationship and an adjusted fuel injection relationship.

In certain embodiments, a change occurring at one operating condition can be extrapolated to another operating condition or all operating conditions. For example, the injection delay observed in FIG. 4 can be understood to provide an understanding of an injection delay that would be observed at FIG. 2 (both are at pressure P1, even though the commanded on-times are different). Accordingly, in one example, an operation to provide a fuel injection event at P1, T1 can adjust the injection start time and/or the commanded injection duration in response to the updated injection delay information and provide for a fueling event that is closer to a designed fueling event. Referencing FIG. 5, illustrative data 500 depicts a corrected rate shape model 502, which is consistent with a rate shape model initially updated according to observed data from FIG. 3 (adjusted curve 304), with a delay added from subsequently observed data from FIG. 4 (adjusted injection delay 408). The initial rate shape model 204 is shown for reference.

Figure 6:
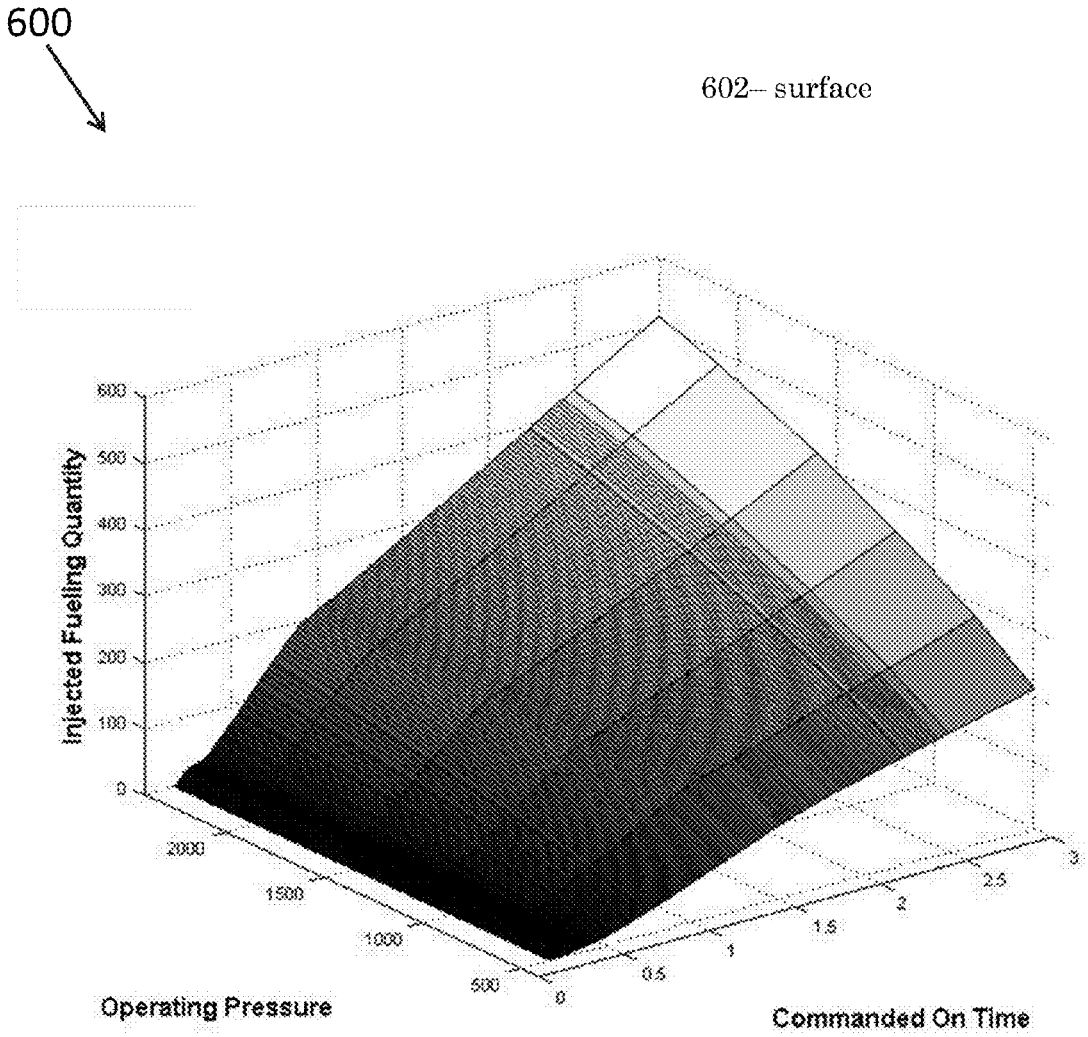
FIG. 6 is a schematic diagram of an example injector operating surface.

Referencing FIG. 6, illustrative data 600 depicts an injector operating surface 602. The injector operating surface 602 is a fueling quantity as a function of system operating conditions. The selected system operating conditions in the example of FIG. 6 are the commanded on-time and the operating pressure (fuel rail pressure). The operating condition could include alternative or additional defining conditions such as the temperature and the discharge pressure. The fueling quantity data can be populated initially through calibration, testing, and/or default values, and updated through observed injection events over the life cycle of the injector. A curve 502 such as that depicted in FIG. 5 can be utilized to provide a data point for the surface 602. The integrated area under the curve 502 such as that depicted in FIG. 5 corresponds to an injected fueling quantity which corresponds to a data point for the surface 602. In a similar manner, the integrated area under the curve 408 such as that depicted in FIG. 4 corresponds to an injected fueling quantity which corresponds to an additional data point for the surface 602. Various data handling procedures may be utilized with the surface 602, such as but not limited to smoothing of the surface where data anomalies occur, requiring repeated observations to move a data point, filtering the movement of data points, providing limits (upper or lower) to how far data points are allowed to move either over time, per observation, and/or absolute limits to the data values allowed.

Figure 7:
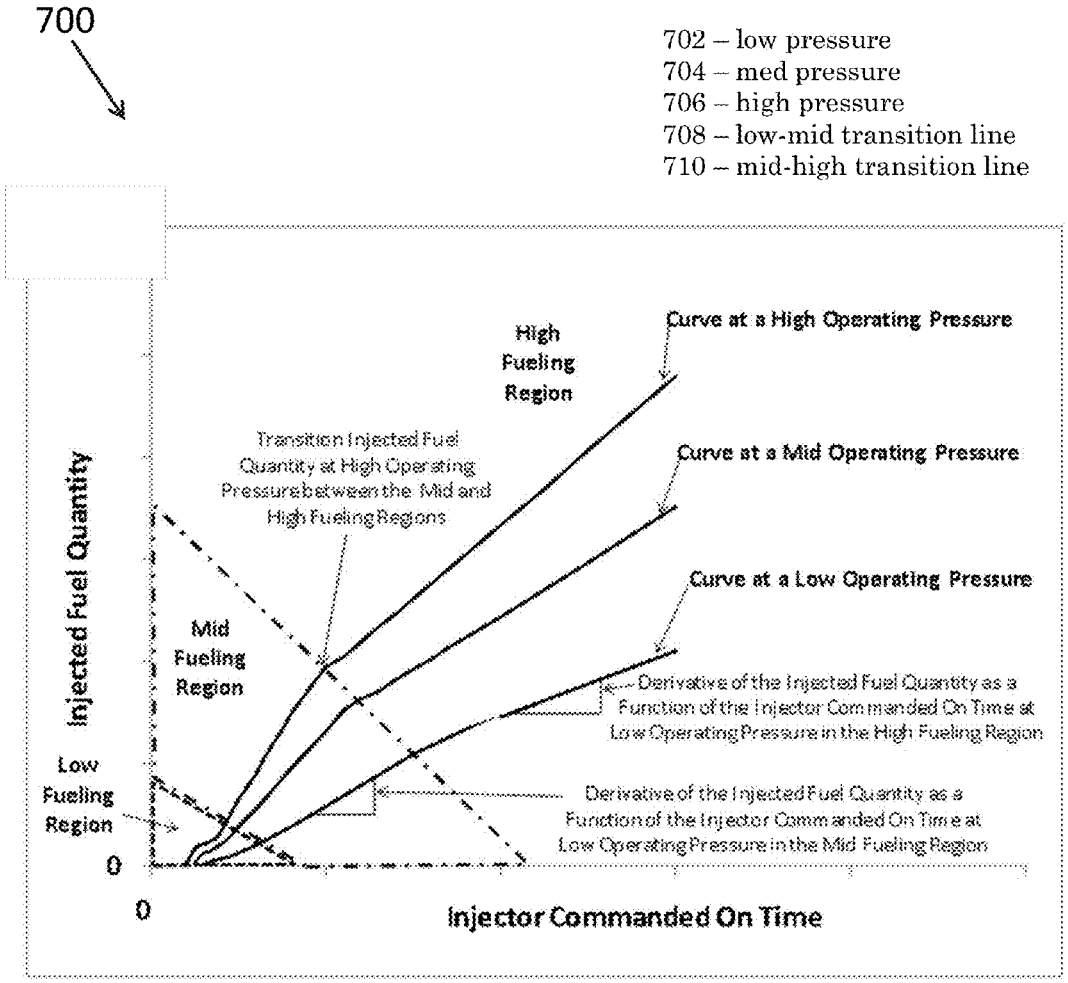
FIG. 7 is a schematic diagram of a number of injection trajectories corresponding to a number of operating conditions.

Referencing FIG. 7, illustrative data depicts an injector relationship 700 stored as a number of injector trajectories which include a fuel quantity versus an injector commanded on-time. It can be seen that the illustrative data 700 includes operating curves divided into three fueling regimes, a low fueling region (below transition line 708), a mid fueling region (between transition lines 708, 710), and a high fueling region (above transition line 710). The operating curves shown in FIG. 7 corresponds to curves corresponding to three operating pressure conditions on the injector operating surface 602 shown in FIG. 6. The transition lines 708, 710 provide for convenient data organization, and at a given operating condition 702, 702, 706 the fueling data for the injector is approximately linear with commanded on-time. The low fueling region could be stored as a combined delay time and a linear fueling value, with the mid-fueling and high-fueling regions stored as linear fueling values. The slope of the fueling lines can be determined from the derivative of fueling amount data, and/or from the storage of individual data points as commanded on-times landing along the operating curve are observed and fueling amount data accumulated. The position of the transition lines 708, 710 may be static, e.g. predefined at time of calibration or manufacture, or may be flexible over time. The position of the transition lines 708, 710 may move for some operating conditions 702, 704, 706 and not for others. The set of individual data points along the operating curves 702, 704, 706 that provides the most linear values (e.g. greatest $R^2$ value) for the operating curves 702, 704, 706 may be utilized if that data is available.

The system operating conditions in the example injector relationship 700 are divided into a high pressure curve 706, a medium pressure curve 704, and a low pressure curve 702. However, a greater number of curves, or fewer curves, may be utilized to provide the injector relationship. The relationship between the parameters in the control structure can include many forms such as a response surface or by any number of curves which represent the response surface. The data may be interpolated or extrapolated when the system is operating at a condition that does not fall on one of the operating curves 702, 704, 706. The injector relationship 700 may be updated over time as fueling events occur and are mapped, for example as depicted in FIGS. 1-5. Data generated in a data structured such as that depicted in FIG. 7 can also be utilized to update a model such as that depicted in FIGS. 1-5—for example the slope and intercept values from the mid- and high-fueling regions may be utilized to determine various parameters from the models (104, 204, 304, etc.) A given system may utilize the injector relationship 700, the surface 602, the models (104, 204, 304, etc.), or combinations of these.

Figure 8:
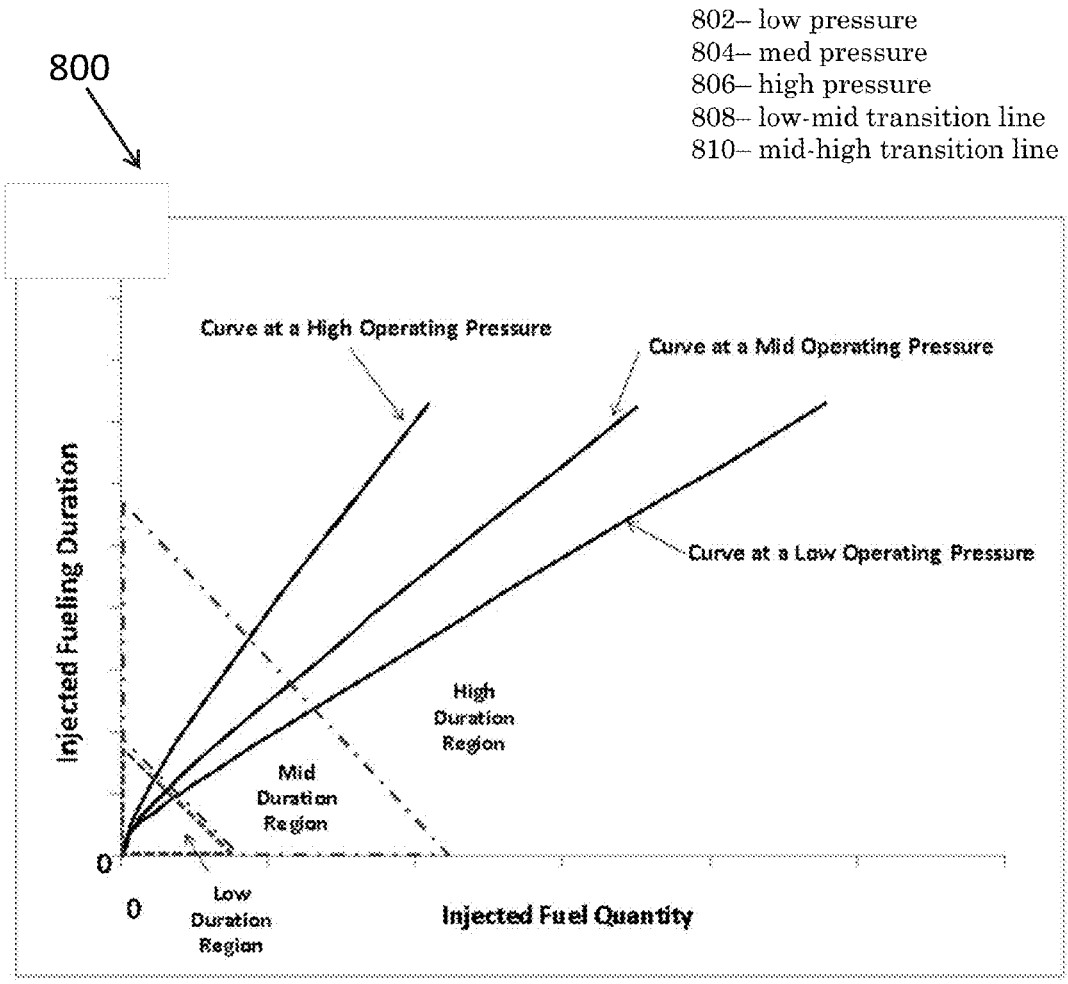
FIG. 8 is a schematic diagram of a number of injection trajectories corresponding to a number of operating conditions.

Referencing FIG. 8, an injector relationship 800 is depicted showing injector fueling duration as a function of injector fueling quantity. Note that in the example relationship 800, the injector delay time is not depicted and could be stored in a separate data structure. Data such as that depicted in FIG. 8 may be utilized to build, inform, or update other models in the system. The curve 802 depicts a low pressure operating curve, the curve 804 depicts a mid pressure operating curve, and the curve 806 depicts a high pressure operating curve. The low-mid transition 808 and the mid-high transition 810 may be the same or distinct transition values from the low-mid transition 708 and the mid-high transition 710. The curves are shown for illustrative purposes, the control structure may represent the relationship as a response surface, in tabular form, or in any other appropriate manner.

The control structure can be designed to utilize information at multiple operating conditions in order to refine, update and check each of the modeling parameters used to represent the rate shape characteristics of an injector during an injection event for all operating conditions. Based on the injector characteristics, some of the rate shape defining parameters can have stronger signal to noise ratios at operating condition regions which can be advantageously utilized by the control structure. As an illustrative example, there can be a relatively strong correlation in the relationship between the injected fueling quantity and the opening delay at operating conditions for which the injection quantity is relatively low. As another illustrative example, there can be a relatively strong correlation in the relationship between the peak rate and the rate of change of the injected fueling quantity with respect to the commanded on time at operating conditions for which the injection quantity is relatively high.

Although a control structure which utilizes information at multiple operating conditions in order to refine, update and check each of the modeling parameters used to represent the rate shape characteristics of an injector during an injection event for all operating conditions has beneficial quantities, it is not a requirement. A control structure can determine all the values which define the completed rate shape utilizing methods and information based only on the fueling quantity estimation at a singular operating condition. As a simple illustrative example of such a control structure at the operating condition shown in FIG. 3

Further example modeling concepts are described following, which may be utilized as a fuel injection model, to update a fuel injection model, and/or to diagnose a fuel injector. Referencing FIG. 3, it can be seen that the adjusted curve 304 can be generated by adjusting the model, decreasing the peak injection rate and increasing the end delay 308. As used herein, adjusting can refer to the process by which the performance of an injector changes, or adjusts, over time due to wear, fouling, debris, etc. No limitation is intended regarding the scope of the term "adjusting". In some forms "adjusting" can refer to the process by which the rate shape is adjusted to account for wear, fouling, debris, etc. Referencing any one of the trapezoidal rate shape models, including FIG. 4 for example, the fueling amount during the injection event can be calculated from the modeling parameters as $$Q_0 = R_0 * \left(T_{duration\,0} - \frac{T_{open\,0}}{2} - \frac{T_{close\,0}}{2}\right),$$

where $Q_0$ is the amount of fuel injected, $R_0$ is the peak injection rate, $T_{open0}$ is the time from beginning of injection to peak injection, $T_{close0}$ is the time from the drop from peak injection to end of injection, and $T_{duration}$ is the time between the beginning and end of injection. The total amount of fuel injected can be compared with, for example, a virtual fuel estimator such as described in U.S. Pat. No. 6,557,530. The control structure can take an action based on the magnitude of the difference between the estimated fueling quantity measured and the estimated fueling quantity as calculated from the modeling parameters at the operating condition.

At some other time during the engine operation, while operating at the same condition, a fueling estimate injected fueling quantity is estimated and/or measured using one of any number methods including the methods detailed in U.S. Pat. No. 6,557,530. At this time, the estimated injected fueling quantity is found to be Q1 which differs from the previously estimated the injected fueling quantity, Q0. A control structure can be utilized to estimate the changes to the injection rate shape at this operating condition based on the change in the injected fueling quantity from Q0 to Q1. For example, the control structure may utilize known, estimated relationships between the rate shape parameters of the injector to estimate the injector's rate shape changes.

In another example that involves the trapezoidal shaped rate shape shown in FIG. 2, the injected fuel quantity, Q0, is the area under the curve and can be calculated using the equation:

$$Q0 = R0*(T\text{duration}0 - T\text{open}0/2 - T\text{close}0/2). \qquad \text{Eq\#1}$$

At this operating condition, the injected fueling quantity is estimated and/or measured using one of any number methods including the methods detailed in U.S. Pat. No. 6,557,530. This estimated fueling quantity can be compared to the estimated fueling quantity value Q0.

At some other time during the engine operation, while operating at the same condition as shown in FIG. 2, a fueling estimate injected fueling quantity is estimated and/or measured using one of any number methods including the methods detailed in U.S. Pat. No. 6,557,530. At this time, the estimated injected fueling quantity is found to be Q1 which differs from the previously estimated the injected fueling quantity, Q0.

For the trapezoidal shaped rate shape shown in FIG. 3, the injected fuel quantity, Q1, is the area under the curve and can be calculated using the equation:

$$Q1 = R1*(T\text{duration}1 - T\text{open}1/2 - T\text{close}1/2). \qquad \text{Eq\#2}$$

A control structure can be utilized to estimate the changes to the injection rate shape at this operating condition based on the change in the injected fueling quantity from Q0 to Q1. For example, the control structure may utilize known, estimated relationships between the rate shape parameters of the injector to estimate the injector's rate shape changes. As an illustrative example, the injection duration and the peak injection rate at this operating condition could be modeled in the control structure which utilizes the following relationship:

$$(T\text{duration}1 - T\text{duration}0) = Cdr*[1-(R1/R0)]. \qquad \text{Eq\#3}$$

In this equation Cdr is estimated as a term relating the change in the injection duration and the change in the peak injection rate.

The control structure could also model the injector at this operating point to follow the additional relationships:

$$T\text{open}1 = T\text{open}0 \qquad \text{Eq\#4}$$

and $$T\text{close}1 = T\text{close}0 \qquad \text{Eq\#5}$$

Based on the change in the injected fueling quantity from Q0 to Q1 and these relationships, all the values which define the completed rate shape can be fully estimated utilizing the defined mathematical relationships in a control structure. An example of the use of such a model is shown in FIG. 5 at an operating condition based on the fueling quantity decreasing from Q0 to Q1.

For the example shown in the FIG. 3, the fueling rate decrease results in an estimated injection duration increase and a peak injection rate decrease relative to the initial rate shape. Based on the defined mathematical relationships for this example, the opening and closing injection slope values are calculated within the control structure to drop proportionately with the peak injection rate decrease.

Based on the estimated injected fueling quantity changing from Q0 to Q1 at a singular operating fueling condition, the peak injection rate change from R0 to R1 can be mathematically determined using the estimated relationships shown in Eq#1, Eq#2, Eq#3, Eq#4 and Eq#5.

$$R1 = \left[\left(R0 + \frac{Q0}{Cdr}\right) - \sqrt{R0^2 + \frac{2*R0*Q0}{Cdr} + \frac{Q0^2}{Cdr^2} - \frac{4*R0*Q1}{Cdr}}\right] \Big/ 2 \qquad \text{Eq \#6}$$

Based on the estimated injected fueling quantity changing from Q0 to Q1 at a singular operating fueling condition, the injection duration change from Tduration0 to Tduration1 can be mathematically determined using the estimated relationships shown in Eq#3 and Eq#6.

$$(Tduration1 - Tduration0) = Cdr*\left\{1 - \left[\left(R0 + \frac{Q0}{Cdr}\right) - \sqrt{R0^2 + \frac{2*R0*Q0}{Cdr} + \frac{Q0^2}{Cdr^2} - \frac{4*R0*Q1}{Cdr}}\right] \Big/ (2*R0)\right\} \qquad \text{Eq \#7}$$

For an alternative injector configuration embodiment, as opposed to the time from the start of injection to the peak injection remaining constant as the peak injection rate changes, the time from the start of injection to the peak injection may change proportionally as the peak injection rate changes as shown in Eq #8.

$$Topen1=R1*Topen0/R0 \quad \text{Eq\#8}$$

Likewise, for this alternative injector configuration embodiment, as opposed to the time from the start of injection rate drop to the end of the injection remaining constant as the peak injection rate changes, the time from the start of injection rate drop to the end of the injection may change proportionally as the peak injection rate changes as shown in Eq #9.

$$Tclose1=R1*Tclose0/R0 \quad \text{Eq\#9}$$

Based on the estimated injected fueling quantity changing from Q0 to Q1 at a singular operating fueling condition, the peak injection rate change from R0 to R1 can be mathematically determined using the estimated relationships shown in Eq#1, Eq#2, Eq#3, Eq#8 and Eq#9.

$$R1 = \frac{\left[\left(Q0 + \frac{R0(Topen0 + Tclose0)}{2} + RoCdr\right) - \sqrt{\left[Q0 + \frac{R0(Topen0 + Tclose0)}{2} + RoCdr\right]^2 - 2(Topen0 + Tclose0 + Cdr)(Q1 * R0)}\right]}{(Topen0 + Tclose0 + 2 * Cdr)} \quad \text{Eq \#10}$$

Based on the estimated injected fueling quantity changing from Q0 to Q1 at a singular operating fueling condition, the injection duration change from Tduration0 to Tduration1 can be mathematically determined using the estimated relationships shown in Eq#3 and Eq#10.

$$(Tduration1-Tduration0)=Cdr*[1-(R1/R0)]. \quad \text{Eq\#11}$$

In another example, referencing FIG. 3, the relationship before and after adjustment holds in many circumstances (the injection is extended inversely proportionally to the peak injection rate):

$$(T_{duration1} - T_{duration0}) = 1 - \frac{R_1}{R_0},$$

where $R_1$ is the peak rate after adjustment and $T_{duration1}$ is the injection time after adjustment, and that $R_0$ is the peak rate before adjustment and $T_{duration0}$ is the injection time before adjustment. In another separate and/or concurrent example, depending upon the type and dynamics of the injector, the injector opening time (after initial delay) and injector closing time are constant: $T_{open0}=T_{open1}$ and $T_{close0}=T_{close1}$. Based on the change in the injected fueling quantity from Q0 to Q1 and these relationships, all the values which define the completed rate shape can be fully estimated utilizing the defined mathematical relationships in a control structure. An example of the use of such a model is shown in FIG. 3 at an operating condition based on the fueling quantity decreasing from Q0 to Q1.

For the example shown in the FIG. 3, the fueling rate decrease results in an estimated injection duration increase and a peak injection rate decrease relative to the initial rate shape. Based on the defined mathematical relationships for this example, the opening and closing injection slope values are calculated within the control structure to drop proportionately with the peak injection rate decrease.

The control structure may model the injection rate shape as having differing characteristics as a function of the operating condition. For example, at lower injection quantities than is shown in FIG. 1, the rate shape could be estimated by any shape which can be used to represent any actual injection rate shape. In this example, the actual injection rate shape at a low fueling operating condition could be modeled as a trapezoidal injection event as depicted in FIG. 3, with an opening slope of the injection can be estimated as $m_{open}$ $c_0$*IFQ+$c_1$*$\sqrt{IFQ}$, where $m_{open}$ is the opening slope, IFQ is the injected fuel quantity, and $c_0$, $c_1$ are matching coefficients which have values dependent upon the system operating conditions (e.g. operating pressure, temperature). An example model for a trapezoidal injection event models a closing slope as a constant value. An example model for a trapezoidal injection event models an injection delay time (before first opening) as:

$$IOD = c_2 + \frac{c_3}{IFQ},$$

where IOD is the injection opening delay, and where c2, c3 are matching coefficients dependent on operating conditions.

As an illustrative example of the effect of a fueling change at an operating condition, FIG. 4 contains two approximated rate shapes. One of the rate shapes is labeled as "initial" and another injection rate shape at the same operating conditions was run with the initial rate shape and which is labeled as "after performance change #2". In this example, the operational performance change to rate shape of the injector as shown includes a decrease the injected quantity Based on the change in the fueling quantity from Q2 to Q3 at this operating condition and the relationship between the fueling quantity and the opening and closing slopes, all the values which define the completed rate shape can be fully estimated utilizing the defined mathematical relationships in a control structure including the injection opening delay, the injection opening rate slope and the injection closing rate slope.

An example control structure can additionally improve its estimate of the injection rate shape defining characteristic parameters at an operating condition by utilizing the estimates of the injected fueling quantity values at multiple operating conditions. A simple illustrative example of the use of the estimates of the fueling quantity values at multiple operating conditions is obtained by utilizing both the fueling quantity estimate values represented in FIGS. 2 through 4 to obtain the injection rate shape estimate shown in FIG. 5. The operating condition shown in FIG. 5 is the same operating condition represented in 2 through 4. In this illustrative example since the injected fuel quantity, Q1, is the same in the rate shapes shown in FIG. 3 and FIG. 5, the injection duration, the peak injection rate, the opening rate slope and the closing rate slope of the injection fueling rate shape curve 502 in FIG. 5 are all unchanged from the injection fueling rate shape curve labeled as "after performance change #1" in FIG. 3. However, as an illustrative example, a control structure can utilize the start of injection delay change information for this injector based on the fueling change at the operating condition shown in FIG. 4 to estimate that the injector also has a start of injection delay change at the operating condition shown in FIG. 5.

A control structure which utilizes the estimates of the injected fueling quantity values at a plurality of operating conditions can improve its estimate of the injection rate shape defining characteristic parameters at each of these operating conditions. The injected fueling quantity may be estimated and/or measured at multiple operating conditions using one of any number methods including the methods detailed in U.S. Pat. No. 6,557,530. The factors which affect the injected fueling quantity at these operating conditions may include the operating pressure, the commanded on-time, the discharge pressure, the operating temperature, as well as any other input factor which affects the injected fueling quantity. The relationship between the injected fueling quantity and these input factors at the multiple operating conditions can be represented by any number of methods including mathematical relationships, models, and control tables. One of many such possible relationships is the relationship between the injected fueling quantity and the operating pressure and the commanded on-time for an injector. For this illustrative example, at any operating condition, the injected fueling quantity is estimated at the operating commanded on-time and operating system pressure. These injected fueling quantity, commanded on-time and operating system pressure data sets can be similarly obtained by the control structure at multiple operating conditions. The relationship between these parameters can be modeled in the control structure. FIG. 6 is a graphical representation of such a relationship which can be obtained in the control structure and represents the injected fueling quantity of an example injector as a function of the operating pressure and the commanded on-time.

FIG. 7 is a two dimensional graphical representation of the relationship shown in FIG. 6 which can be obtained in the control structure and represents the injected fueling quantity of an example injector as a function of the operating pressure and the commanded on-time. As shown in FIG. 7, the relationships between parameters may displays trends in different regions of the operational domain of the injector. For example, in FIG. 7 the data is shown to be divided into three operational regions: the low fueling region, the mid fueling region, and the high fueling region. The control system may consider these transitional region boundaries to be static or the transition boundaries can be allowed to be determined during an adaptation process and shift over time.

As is shown in FIG. 7, there are many derived parameters which can be used to quantity the characteristic values for the response such as: the transition injected fueling quantity at the inflection points between the fueling regions and the derivative of the injected fueling quantity as a function of the injector commanded on time as a function of the operating pressure and the fueling region.

The control structure utilizes information from factors which affect the injected fueling quantity at a single or multiple operating conditions such as: the operating pressure, the commanded on-time, the discharge pressure, the operating speed and the operating temperature in order to estimate the rate shape defining characteristic parameters. For example, the injected fueling duration at each operating point may be defined in the control structure to be dependent on parameters such as the estimated fueling quantity or quantities, the transition injected fueling quantity at the inflection points between the fueling regions, the derivative of the injected fueling quantity as a function of the injector commanded on time, the operating pressure and the discharge pressure. For example, FIG. 6 is a graphical representation of the result of such as relationship which can be obtained in the control structure to represent the injected fueling duration of an example injector as a function of the operating pressure and the injected fueling quantity. By measuring and/or estimating the injected fueling quantity or quantities at a single or multiple operating conditions for an injector in the system, the control structure can estimate rate shape defining characteristic parameters such as the injected fueling duration as in shown in FIG. 8.

In a similar manner, by measuring and/or estimating the injected fueling quantity or quantities at a single or multiple operating conditions for an injector in the system, the control structure can estimate all additional rate shape defining characteristic parameters such as, but not limited to: the start of injection delay time between the command signal and the start of injection, the end of injection delay time between the command signal and the end of injection, the peak injection rate, the opening injection slope characteristic terms, and the closing injection slope characteristic terms.

The start of injection delay time for typical injectors is often strongly dependent in the control structure to parameters such as the commanded on time required to achieve an injected fueling quantity level as a function of the operating pressure. One method for the control structure to estimate the end of injection delay time is the commanded on time subtracted from the sum of the start of injection delay and the injected fueling duration. The peak injection rate for typical injectors is often strongly dependent in the control structure to parameters such as the derivative of the injected fueling quantity in the high fueling region as a function of the injector commanded on time and the operating pressure. The opening and closing injection slope characteristic terms for typical injectors are often strongly dependent in the control structure to parameters such as the derivative of the injected fueling quantity in the mid fueling region as a function of the injector commanded on time and the operating pressure. As with all of these relationships used to determine the rate shape defining characteristics of an injector at all operating conditions, the specific method utilized by the control structure depends on the interrelationships of these parameters for a specific injector's performance.

An example of an illustrative control structure process which can be utilized to update the rate shape characteristics terms of the injector consists of several sequential steps. The process begins with the control structure receiving individual fueling estimate or estimates and all the required associated measured or estimated values of the operating condition defining parameters. The control structure adapts the mathematical relationship parameters or relationships or model in any form which relates the injected fueling quantity to the operating condition defining parameters such as the commanded on-time and the operational pressure. The form of the expression of these relationships may vary in differing operational regions. The control system then calculates an estimate of the injected duration in one or more of these fueling regions as a model or function of any form based on relationships which are estimated based on the mathematical relationship or relationships or model which relates the injected fueling quantity to variables such as the commanded on-time and the pressure. The control structure then calculates an estimate of the start of injection delay time between the command signal and the start of injection in one or more of these fueling regions as a model or function of any form based on relationships which are estimated based on the mathematical relationship or relationships or model which relates the injected fueling quantity to variables such as the commanded on-time and the pressure. The control structure then calculates an estimate of the end of injection delay time between the command signal and the end of injection. The control structure then calculates all other injection rate characteristic terms which define an injection rate shape. These estimated injection rate shape characteristic terms may include terms such as the peak injection rate, the opening injection slope characteristic terms, and the closing injection slope characteristic terms in one or more of these fueling regions as a model or function of any form based on relationships which are estimated based on the mathematical relationship or relationships or model which relates the injected fueling quantity to variables such as the commanded on-time and the pressure parameters for a specific injector's performance.

The adaptation process in the control structure used to update and adapt for the rate shape characteristics of the injector at a single or multiple operating conditions involves periodically receiving individual fueling estimates, each associated with the operating condition such as the commanded on time, the operating rail pressure, the temperature, the discharge pressure, the operating speed and any other relevant factors. The control structure uses the information to make incremental updates to models or any other beneficial control structures in the appropriate fueling regions. These models may typically be simple mathematical relationships, regression equations, adaptive tables, or some hybrid mix of equations and tables, each of which is a function of operating parameters.

An example system further includes a means for updating the model of the fuel injector fuel quantity and diagnosing the fuel injector in response to a current operating condition and a fueling quantity during a fuel injection event. An example non-limiting means for updating the model of the fuel injector fuel quantity includes utilizing a fuel amount estimation during a fuel injection event, and adjusting one or more parameters from a model consistent with embodiments described in any one or more of FIGS. 1 through 8 inclusive.

In certain embodiments, an example system includes an apparatus structured to perform certain operations to diagnose an injector and to update an injector controller and model. An embodiment of the apparatus includes a controller forming a portion of a processing subsystem including one or more computing devices having memory, processing, and communication hardware. The controller may be a single device or a distributed device, and the functions of the controller may be performed by hardware or software.

In certain embodiments, the controller includes one or more modules structured to functionally execute the operations of the controller. In certain embodiments, the controller includes an injector definition module, an injector characterization module, an injector updating module, and/or an injector diagnostic module. The description herein including modules emphasizes the structural independence of the aspects of the controller, and illustrates one grouping of operations and responsibilities of the controller. Other groupings that execute similar overall operations are understood within the scope of the present application. Modules may be implemented in hardware and/or software on a non-transient computer readable storage medium, and modules may be distributed across various hardware or software components. More specific descriptions of certain embodiments of controller operations are included in the section referencing FIG. 9.

Certain operations described herein include operations to interpret one or more parameters. Interpreting, as utilized herein, includes receiving values by any method known in the art, including at least receiving values from a datalink or network communication, receiving an electronic signal (e.g. a voltage, frequency, current, or PWM signal) indicative of the value, receiving a software parameter indicative of the value, reading the value from a memory location on a non-transient computer readable storage medium, receiving the value as a run-time parameter by any means known in the art, and/or by receiving a value by which the interpreted parameter can be calculated, and/or by referencing a default value that is interpreted to be the parameter value.

Figure 9:
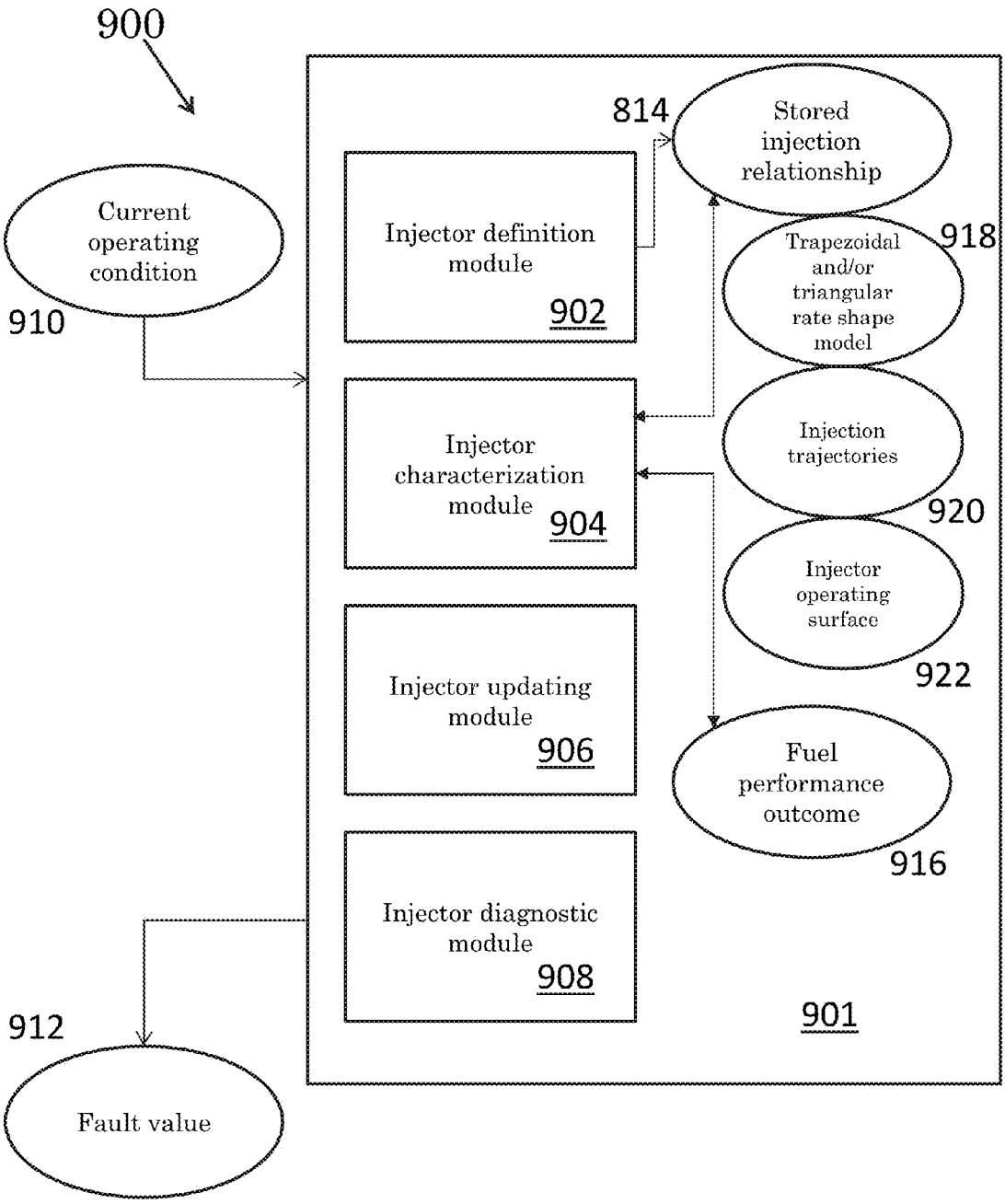
FIG. 9 is a schematic diagram of a processing subsystem including a controller structured to functionally execute operations to update and diagnose an injector controller.

FIG. 9 is a schematic illustration of a processing subsystem 900 including a controller 901. The controller 900 includes an injector definition module that interprets a stored injection relationship 814. An example stored injection relationship 814 includes a number of fuel command parameters corresponding to a number of fuel performance parameters at a specified operating condition. The controller 900 includes an injector characterization module 904 that determines a fuel performance outcome 916 during a fuel injection event, and an injector updating module 906 that interprets a current operating condition 910, and updates the stored injection relationship 814 in response to the fuel performance outcome 916 and the current operating condition 910. An example stored injection relationship 814 includes an injector model such as described in FIGS. 1-8 before adjustment, and an example update to the stored injection relationship 814 includes an updated model after adjustment, such as depicted in FIGS. 3-5 or FIGS. 6-8 after adjustment (not shown).

An example controller 901 includes the stored injection relationship 814 being a trapezoidal injector rate shape 918 corresponding to a fuel pressure value and an injector commanded on time. The example controller 901 includes the stored injection relationship 814 further including a start of injection delay, an end of injection delay, a peak injection rate, a time from start of injection to peak injection, a time from start of injection rate drop to end of injection, an opening rate shape slope, and/or a closing rate shape slope. Another example controller 901 includes the stored injection relationship 814 including an injection trajectory 920 which includes an injected fuel quantity versus injector commanded on time for a low-fueling, a mid-fueling, and a high-fueling region. In certain further embodiments, the controller 901 includes the stored injection relationship 814 further having a number of injection trajectories 920, each corresponding to an operating pressure value.

An example controller 901 includes the stored injection relationship 814 having an injector operating surface 922, the injector operating surface including an injected fuel quantity as a function of a fuel pressure value and an injector commanded on time. In certain embodiments, the stored injection relationship is a triangular injection rate shape 918, and may further include a start of injection delay, an end of injection delay, an opening rate shape slope, and/or a closing rate shape slope. An example controller 901 includes the specified operating condition 814 being a fuel rail pressure, a fuel temperature, an injector discharge pressure, an engine operating speed, and an injector commanded on-time. An example controller 901 includes an injector diagnostic module 908 that provides a fault value 912 in response to the fuel performance outcome and the current operating condition.

The schematic flow descriptions which follow provide illustrative embodiments of performing procedures for adjusting control of a fuel injector and diagnosing injector failures and off nominal operation. Operations illustrated are understood to be exemplary only, and operations may be combined or divided, and added or removed, as well as re-ordered in whole or part, unless stated explicitly to the contrary herein. Certain operations illustrated may be implemented by a computer executing a computer program product on a non-transient computer readable storage medium, where the computer program product comprises instructions causing the computer to execute one or more of the operations, or to issue commands to other devices to execute one or more of the operations.

An procedure includes an operation to interpret an injector characteristic, the injector characteristic including a command value to injection quantity relationship. The procedure further includes an operation to determine an injected quantity of an injector during a fueling event of the injector, and an operation to determine an injection deviation value in response to the injector characteristic and the injected quantity.

A procedure includes an operation to update the injector characteristic in response to the injection deviation value. An example injector characteristic includes a start of injection delay, an end of injection delay, a peak injection rate, a time from start of injection to peak injection, a time from start of injection rate drop to end of injection, an opening rate shape slope, and/or a closing rate shape slope. In certain further embodiments, the injector characteristic includes a trapezoidal injection rate shape.

An example injector characteristic includes a start of injection delay, an end of injection delay, an opening rate shape slope, and/or a closing rate shape slope. In certain embodiments, the injector characteristic includes a triangular injection rate shape. An example injector characteristic includes a command value to injection quantity relationship at a specified operating condition. Example specified operating conditions include a fuel rail pressure, a fuel temperature, an injector discharge pressure, an engine operating speed, and/or an injector commanded on-time. An example procedure includes an operation to update the injector characteristic in response to the injection deviation value. An example procedure includes an operation to provide a fault value in response to the injection deviation value.

Yet another example procedure includes an operation to determine a stored injection relationship having a number of fuel command parameters corresponding to a number of fuel performance parameters at a specified operating condition. The procedure further includes an operation to determine a fuel performance outcome during a fuel injection event, and an operation to update the stored injection relationship in response to the fuel performance outcome and a current operating condition.

An example procedure includes the stored injection relationship being a trapezoidal injector rate shape corresponding to a fuel pressure value and an injector commanded on time. An example method includes the stored injection relationship being an injection trajectory that includes an injected fuel quantity versus injector commanded on time for a low-fueling, a mid-fueling, and a high-fueling region. In a further example, the stored injection relationship further includes a number of injection trajectories, each corresponding to an operating pressure value. An example procedure includes the stored injection relationship being an injector operating surface, where the injector operating surface includes an injected fuel quantity as a function of a fuel pressure value and an injector commanded on time.

Figure 10:
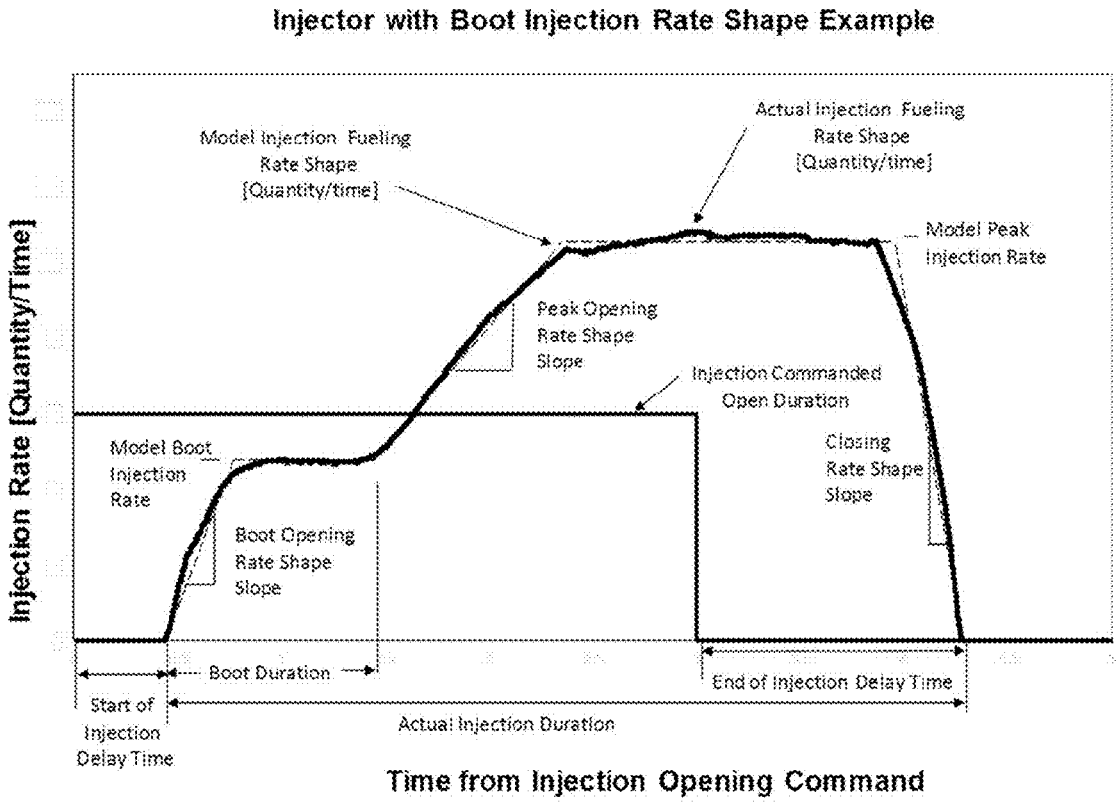
FIG. 10 is a schematic diagram of a fuel injection relationship.

FIG. 10 shows another illustrative possible embodiment of an example injection rate shape at an operating condition. In this embodiment, the actual injection rate shape is shown to be estimated and modeled by a boot shaped initial injection rate shape followed by an approximately trapezoidal rate shape. For the rate shape shown in FIG. 10, the injection rate characteristic parameters include parameters such as the injection duration, the start of injection delay time, the end of injection delay time, the peak injection rate, the opening boot injection slope characteristic terms, the boot injection rate, the boot duration, the boot to peak injection slope characteristic terms, and the closing injection slope characteristic terms.

Figure 11:
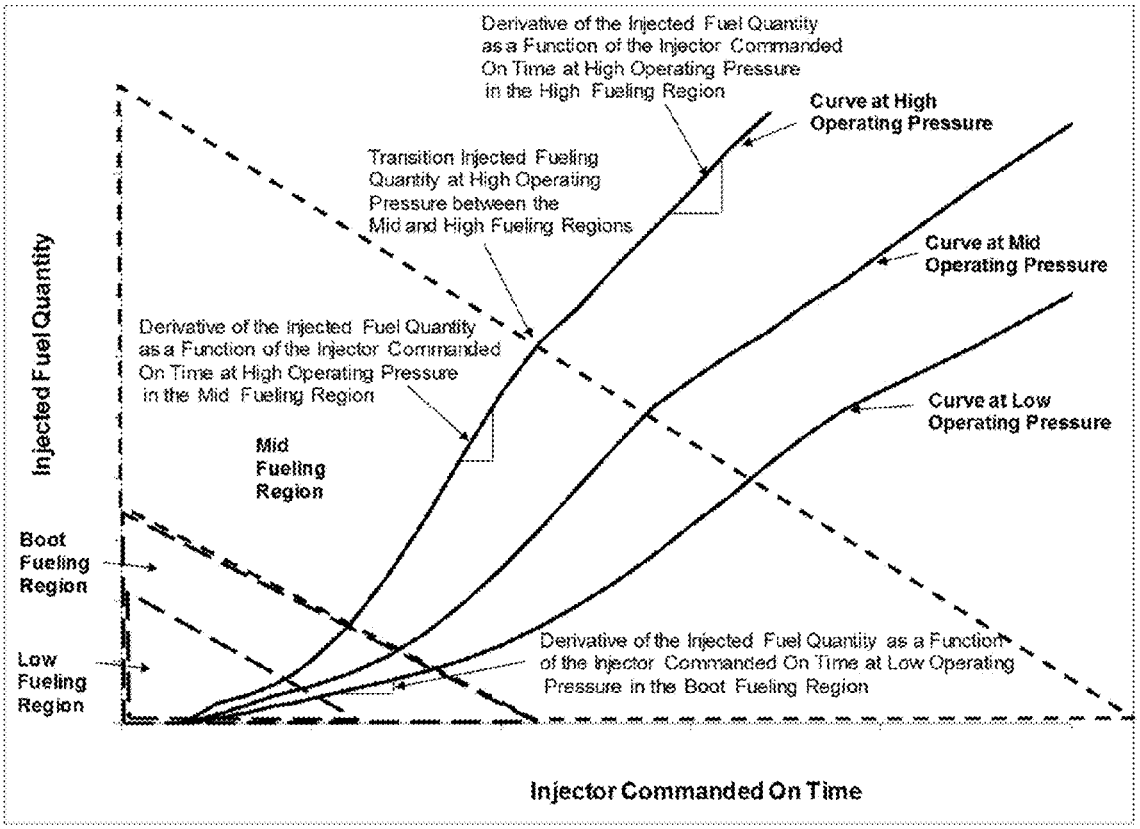
FIG. 11 is a schematic diagram of a number of injection trajectories corresponding to a number of operating conditions.

FIG. 11 is a two dimensional graphical representation of the surface response which can be obtained in the control structure and represents the injected fueling quantity of the illustrative example injector with a boot rate shape as a function of the operating pressure and the commanded on-time. As shown in FIG. 11, the relationships between parameters may displays trends in different regions of the operational domain of the injector. For example, in FIG. 11 the data is shown to be divided into four operational regions: the low fueling region, the boot fueling region, the mid fueling region, and the high fueling region. The control system may consider these transitional region boundaries to be static or the transition boundaries can be allowed to be determined during an adaptation process and shift over time.

As is shown in FIG. 11, there are many derived parameters which can be used to quantity the characteristic values for the response such as: the transition injected fueling quantity at the inflection points between the fueling regions and the derivative of the injected fueling quantity as a function of the injector commanded on time as a function of the operating pressure and the fueling region.

Figure 12:
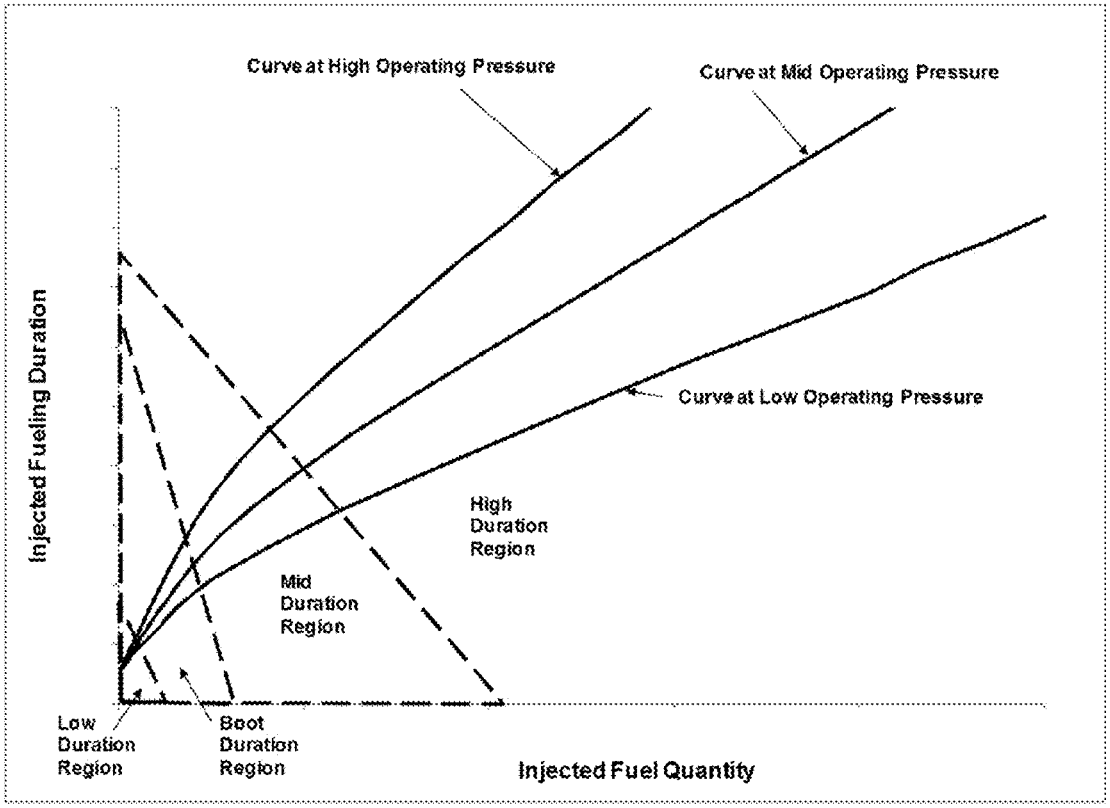
FIG. 12 is a schematic diagram of a number of injection trajectories corresponding to a number of operating conditions.

The control structure utilizes information from factors which affect the injected fueling quantity at a single or multiple operating conditions such as: the operating pressure, the commanded on-time, the discharge pressure, the operating speed and the operating temperature in order to estimate the rate shape defining characteristic parameters. For example, the injected fueling duration at each operating point may be defined in the control structure to be dependent on parameters such as the estimated fueling quantity or quantities, the transition injected fueling quantity at the inflection points between the fueling regions, the derivative of the injected fueling quantity as a function of the injector commanded on time, the operating pressure and the discharge pressure. By measuring and/or estimating the injected fueling quantity or quantities at a single or multiple operating conditions for an injector in the system, the control structure can estimate rate shape defining characteristic parameters such as the injected fueling duration as in shown in FIG. 12 for the illustrative boot rate shaped example.

In one non-limiting form the techniques discussed herein can be described as follows:

(1) Define a mathematical relationship or relationships, tables, or models in any form which relates the injected fueling quantity to variables such as the commanded on-time and the pressure. The form of the expression of these relationships may vary in differing regions of the fueling, commanded on-time, and pressures.

(2) During system operation, estimate the injected fueling quantity at each of a number of operating conditions. Utilize a control structure to adapt the mathematical relationship or relationships or model in any form which relates the injected fueling quantity to variables such as the commanded on-time and the pressure.

(3) Based on relationships which are estimated from the mathematical relationship or relationships or models which relates the injected fueling quantity to variables such as the commanded on-time and the pressure, calculate an estimate of any set or subset of injection rate characteristic terms which define an injection rate. These estimated injection rate characteristic terms may include terms such as: the injected duration, the start of injection delay time between the command signal and the start of injection, the end of injection delay time between the command signal and the end of injection, the peak injection rate, the opening injection slope characteristic terms, and the closing injection slope characteristic terms.

As is evident from the figures and text presented above, a variety of embodiments according to the present disclosure are contemplated.

An example set of embodiments is a method including interpreting an injector characteristic, the injector characteristic including a command value to injection quantity relationship. The method further includes determining an injected quantity of an injector during a fueling event of the injector, and determining an injection deviation value in response to the injector characteristic and the injected quantity.

Certain further embodiments of the method are described following. A method includes updating the injector characteristic in response to the injection deviation value. An example injector characteristic includes a start of injection delay, an end of injection delay, a peak injection rate, a time from start of injection to peak injection, a time from start of injection rate drop to end of injection, an opening rate shape slope, and/or a closing rate shape slope. In certain further embodiments, the injector characteristic includes a trapezoidal injection rate shape.

An example injector characteristic includes a start of injection delay, an end of injection delay, an opening rate shape slope, and/or a closing rate shape slope. In certain embodiments, the injector characteristic includes a triangular injection rate shape.

An example injector characteristic includes a command value to injection quantity relationship at a specified operating condition. Example specified operating conditions include a fuel rail pressure, a fuel temperature, an injector discharge pressure, an engine operating speed, and/or an injector commanded on-time. An example method includes updating the injector characteristic in response to the injection deviation value. An example method includes providing a fault value in response to the injection deviation value.

Yet another example set of embodiments is a method including determining a stored injection relationship having a number of fuel command parameters corresponding to a number of fuel performance parameters at a specified operating condition. The method includes determining a fuel performance outcome during a fuel injection event, and updating the stored injection relationship in response to the fuel performance outcome and a current operating condition. Certain further embodiments of a method are described following.

An example method includes the stored injection relationship being a trapezoidal injector rate shape corresponding to a fuel pressure value and an injector commanded on time. An example method includes the stored injection relationship being an injection trajectory that includes an injected fuel quantity versus injector commanded on time for a low-fueling, a mid-fueling, and a high-fueling region. In a further example, the stored injection relationship further includes a number of injection trajectories, each corresponding to an operating pressure value. An example method includes the stored injection relationship being an injector operating surface, where the injector operating surface includes an injected fuel quantity as a function of a fuel pressure value and an injector commanded on time.

Yet another example set of embodiments is an apparatus including an injector definition module that interprets a stored injection relationship, where the stored injection relationship includes a number of fuel command parameters corresponding to a number of fuel performance parameters at a specified operating condition. The apparatus includes an injector characterization module that determines a fuel performance outcome during a fuel injection event, and an injector updating module that interprets a current operating condition, and updates the stored injection relationship in response to the fuel performance outcome and the current operating condition. Certain further embodiments of the apparatus are described following.

An example apparatus includes the stored injection relationship being a trapezoidal injector rate shape corresponding to a fuel pressure value and an injector commanded on time. The example apparatus includes the stored injection relationship further including a start of injection delay, an end of injection delay, a peak injection rate, a time from start of injection to peak injection, a time from start of injection rate drop to end of injection, an opening rate shape slope, and/or a closing rate shape slope. Another example apparatus includes the stored injection relationship including an injection trajectory which includes an injected fuel quantity versus injector commanded on time for a low-fueling, a mid-fueling, and a high-fueling region. In certain further embodiments, the apparatus includes the stored injection relationship further having a number of injection trajectories, each corresponding to an operating pressure value.

An example apparatus includes the stored injection relationship having an injector operating surface, the injector operating surface including an injected fuel quantity as a function of a fuel pressure value and an injector commanded on time. In certain embodiments, the stored injection relationship is a triangular injection rate shape, and may further include a start of injection delay, an end of injection delay, an opening rate shape slope, and/or a closing rate shape slope. An example apparatus includes the specified operating condition being a fuel rail pressure, a fuel temperature, an injector discharge pressure, an engine operating speed, and an injector commanded on-time. An example apparatus includes an injector diagnostic module that provides a fault value in response to the fuel performance outcome and the current operating condition.

Yet another example set of embodiments is a system including an internal combustion engine having at least one common rail fuel injector, a means for modeling the fuel injector fuel quantity delivered as a function of a fueling command value, and a means for updating the model of the fuel injector fuel quantity and/or diagnosing the fuel injector in response to a current operating condition and a fueling quantity during a fuel injection event. In certain embodiments, the system includes the means for modeling including a trapezoidal injection rate shape estimate, a triangular injection rate shape estimate, a number of fuel quantity trajectories, and/or an injected fuel quantity surface.

While the invention has been illustrated and described in detail in the drawings and foregoing description, the same is to be considered as illustrative and not restrictive in character, it being understood that only certain exemplary embodiments have been shown and described. Those skilled in the art will appreciate that many modifications are possible in the example embodiments without materially departing from this invention. Accordingly, all such modifications are intended to be included within the scope of this disclosure as defined in the following claims.

In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. An apparatus comprising:

a fuel event controller configured for use with a fuel injector for use with a common rail fuel system of an internal combustion engine and having an injector configuration modeled by a rate shape characteristic that includes two or more of an opening rate shape, a start of injection delay, a peak rate, a closing rate shape, an end of injection delay, and an injection duration, the fuel event controller structured to determine one or more of the rate shape characteristics corresponding to the injector configuration by operating upon (1) a fuel value corresponding to an estimate of the injected fuel quantity delivered from the fuel injector; and (2) a relationship which is dictated by the injector configuration and that relates the estimate of the injected fuel quantity to the two or more of the rate shape characteristics.

2. The apparatus of claim 1, wherein the injector configuration changes during operation of the fuel event controller such that the rate shape characteristic of the fuel injector also changes during operation of the reciprocating engine.

3. The apparatus of claim 2, wherein the injector configuration changes between a trapezoidal shape rate shape characteristic, a triangular shape rate shape characteristic, and a shape having an initial boot shape followed by an approximately trapezoidal rate shape.

4. The apparatus of claim 1, wherein the fuel value is a plurality of fuel values that correspond to an estimate of the injected fuel quantity at a first injection event and an estimate of the injected fuel quantity at a second injection event, and where the relationship governed by the injector configuration is a relationship between the estimate of the injected fuel quantities at the first and second injection events and the one or more of the rate shape characteristics.

5. The apparatus of claim 1, where the relationship dictated by the injector configuration is one of a mathematical relationship, a regression equation, an adaptive table, and a hybrid mix of an equation and table.

6. The apparatus of claim 5, wherein the estimate of the injected fuel quantity is structured as a function of operating parameters that include at least one of operating pressure, commanded on time, discharge pressure, operating speed, and temperature.

7. The apparatus of claim 1, wherein one or more of the rate shape characteristics changes as a function of operation parameter.

8. The apparatus of claim 7, wherein a rate shape described by the rate shape characteristics at a first operating condition is different from a rate shape described by the rate shape characteristics at a second operating condition, and wherein at least one of the rate shape characteristics at the second operating condition is set equal to the same of the at least one of the rate shape characteristics determined at the first operating conditions.

9. An apparatus, comprising:

an injector definition module structured to define a stored injection relationship comprising a plurality of fuel injection performance parameters of one or more fuel injectors structured to receive fuel from a common rail fuel system of an engine;

an injector characterization module structured to determine a fuel performance outcome during a fuel injection event; and an injector updating module structured to update at least one of the plurality of fuel injection performance parameters in response to the fuel performance outcome;

wherein the fuel performance outcome comprises an injection trajectory comprising injected fuel quantity versus injector commanded on time for multiple fueling regions.

10. The apparatus of claim 9, wherein the stored injection relationship comprises a trapezoidal injector rate shape corresponding to a fuel pressure value and an injector commanded on time.

11. The apparatus of claim 10, wherein the plurality of fuel injection performance parameters includes at least one of: a start of injection delay, an end of injection delay, a peak injection rate, a time from start of injection to peak injection, a time from start of injection rate drop to end of injection, an opening rate shape slope, and a closing rate shape slope.

12. The apparatus of claim 9, wherein the multiple fueling regions are a low-fueling, a mid-fueling, and a high-fueling region.

13. The apparatus of claim 12, wherein the fuel performance outcome further comprises a plurality of injection trajectories, each corresponding to an operating pressure value.

14. The apparatus of claim 9, wherein the fuel performance outcome comprises an injector operating surface, the injector operating surface comprising an injected fuel quantity as a function of a fuel pressure value and an injector commanded on time.

15. The apparatus of claim 9 wherein the stored injection relationship comprises a triangular injection rate shape.

16. The apparatus of claim 15, wherein the stored injection relationship further comprises at least one value selected from the values consisting of: a start of injection delay, an end of injection delay, an opening rate shape slope, and a closing rate shape slope.

17. The apparatus of claim 9, wherein the fuel performance outcome is determined at a specified operation condition, wherein the specified operating condition comprises at least one operating condition selected from the operating conditions of: a fuel rail pressure, a fuel temperature, an injector discharge pressure, an engine operating speed, and an injector commanded on-time.

18. A method, comprising:

defining a plurality of fuel performance parameters associated with a rate shape characteristic of a fuel injector configured to receive fuel from a common rail fuel system during operation of an internal combustion engine;

determining a fuel performance outcome during a fuel injection event of the fuel injector during operation of the internal combustion engine; and updating at least one of the plurality of fuel performance parameters in response to the fuel performance outcome.

19. The method of claim 18, wherein the rate shape characteristic includes one of a triangle rate shape, a trapezoidal rate shape, and a blended boot/trapezoidal rate shape, and wherein the updating is accomplished using one of a mathematical relationship, a regression equation, an adaptive table, and a hybrid mix of an equation and table that relates fuel performance outcome to the at least one of the plurality of fuel performance parameters.

20. The method of claim 18, wherein the fuel performance outcome comprises an injection trajectory comprising injected fuel quantity versus injector commanded on time for a low-fueling, a mid-fueling, and a high-fueling region.

21. The method of claim 20, wherein the fuel performance outcome further comprises a plurality of injection trajectories, each corresponding to an operating pressure value.

22. The method of claim 18, wherein the fuel performance outcome comprises an injector operating surface, the injector operating surface comprising an injected fuel quantity as a function of a fuel pressure value and an injector commanded on time.

* * * * *